US006608990B1

(12) United States Patent
Gonnella, Jr. et al.

(10) Patent No.: US 6,608,990 B1
(45) Date of Patent: Aug. 19, 2003

(54) JOB ORDERING SYSTEM FOR AN IMAGE-FORMING MACHINE

(75) Inventors: Alfred Gonnella, Jr., Rochester, NY (US); Frederick E. Altrieth, III, Scottsville, NY (US); James A. Zimmer, Jr., Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/692,973

(22) Filed: Oct. 19, 2000

(51) Int. Cl.[7] ..... G03G 15/00
(52) U.S. Cl. ..... 399/382; 399/82; 399/364
(58) Field of Search ..... 399/405, 404, 399/401, 403, 411, 407, 364, 82, 382

(56) References Cited

U.S. PATENT DOCUMENTS

| | | | | |
|---|---|---|---|---|
| 3,564,960 A | | 2/1971 | Foulks | |
| 4,211,483 A | * | 7/1980 | Hannigan et al. | 399/403 X |
| 4,248,525 A | | 2/1981 | Sterrett | |
| 4,427,287 A | | 1/1984 | Matsumoto et al. | |
| 4,519,700 A | | 5/1985 | Barker et al. | |
| 4,536,078 A | | 8/1985 | Ziehm | |
| 4,561,772 A | | 12/1985 | Smith | |
| 4,579,444 A | | 4/1986 | Pinckney et al. | |
| 4,602,776 A | | 7/1986 | York et al. | |
| 4,785,325 A | | 11/1988 | Kramer et al. | |
| 4,892,426 A | | 1/1990 | Steele | |
| 4,924,275 A | * | 5/1990 | Nelson | 399/401 |
| 4,935,786 A | * | 6/1990 | Veeder | 399/403 |
| 4,961,092 A | | 10/1990 | Rabb et al. | |
| 5,050,859 A | | 9/1991 | Paxon | |
| 5,079,598 A | * | 1/1992 | Kaneko et al | 399/364 |
| 5,095,342 A | | 3/1992 | Farrell et al. | |
| 5,107,338 A | * | 4/1992 | Saito | 399/411 X |
| 5,130,750 A | | 7/1992 | Rabb | |
| 5,159,395 A | | 10/1992 | Farrell et al. | |
| 5,184,185 A | | 2/1993 | Rasmussen et al. | |
| 5,272,511 A | | 12/1993 | Conrad et al. | |
| 5,337,135 A | | 8/1994 | Malachowski et al. | |
| 5,339,139 A | | 8/1994 | Fullerton et al. | |
| 5,379,128 A | | 1/1995 | Ishida et al. | |
| 5,423,527 A | | 6/1995 | Tranquilla | |
| 5,457,524 A | | 10/1995 | Metalf et al. | |
| 5,489,969 A | | 2/1996 | Soler et al. | |
| 5,559,595 A | | 9/1996 | Farrell | |
| 5,596,389 A | * | 1/1997 | Dumas et al. | 399/364 |
| 5,598,257 A | * | 1/1997 | Keller et al. | 399/364 |
| 5,642,185 A | | 6/1997 | Altrieth, III et al. | |
| 5,713,061 A | * | 1/1998 | Yoshioka | 399/82 |
| 5,715,514 A | | 2/1998 | Williams et al. | |
| 5,826,157 A | | 10/1998 | Wierszewski | |
| 5,839,045 A | | 11/1998 | Wierszewski | |
| 6,227,531 B1 | * | 5/2001 | Guerrero et al. | 399/404 X |

FOREIGN PATENT DOCUMENTS

| | | | |
|---|---|---|---|
| JP | 5-286606 | | 6/1994 |
| JP | 8-272164 | | 10/1996 |
| JP | 9-151020 | * | 6/1997 |
| JP | 2001-72266 | * | 3/2001 |

OTHER PUBLICATIONS

Yonovich, John R., Dual Function Sheet Feeder, Xerox Disclosure Journal, vol. 19, No. 4, Jul./Aug. 1994, pp. 333–336.

* cited by examiner

*Primary Examiner*—Susan S. Y. Lee

(57) ABSTRACT

A job ordering system for an image-forming machine that transfers an image onto a sheet at essentially the same time in which an inserter places an inserted sheet into a sheet output path. The image-forming machine has image-forming equipment, a sheet output path, and an inserter. The image-forming equipment transfers an image onto a sheet and provides the sheet to the sheet output path. The inserter places an inserted sheet onto the sheet output path at essentially the same time as the image-forming equipment transfers the image onto the sheet. One or more images may be transferred onto a plurality of sheets according to a sheet sequence for an image-forming job. One or more inserted sheets may be placed on the sheet output path at one or more inserted sheet positions.

10 Claims, 7 Drawing Sheets

| FRAME NUMBER | MARKING ENGINE | INVERTER | INSERTER | FINISHER OUTPUT |
|---|---|---|---|---|
| 1 | SHEET 1 - BACK | YES | NO | |
| 2 | EMPTY | | | |
| 3 | SHEET 2 - BACK | YES | NO | |
| 4 | EMPTY | | | |
| 5 | SHEET 4 - BACK | YES | NO | |
| 6 | EMPTY | | | |
| 7 | SHEET 5 - BACK | YES | NO | |
| 8 | EMPTY | | | |
| 9 | SHEET 6 - BACK | YES | NO | |
| 10 | SHEET 1 - FRONT | NO | PASS | SHEET 1 |
| 11 | SHEET 7 - BACK | YES | NO | |
| 12 | SHEET 2 - FRONT | NO | PASS | SHEET 2 |
| 13 | SHEET 8 - BACK | YES | SHEET 3 | SHEET 3 |
| 14 | SHEET 4 - FRONT | NO | PASS | SHEET 4 |
| 15 | SHEET 9 - BACK | YES | NO | |
| 16 | SHEET 5 - FRONT | NO | PASS | SHEET 5 |
| 17 | SHEET 10 - BACK | YES | NO | |
| 18 | SHEET 6 - FRONT | NO | PASS | SHEET 6 |
| 19 | SHEET 11 - BACK | YES | NO | |
| 20 | SHEET 7 - FRONT | NO | PASS | SHEET 7 |
| 21 | SHEET 12 - BACK | YES | NO | |
| 22 | SHEET 8 - FRONT | NO | PASS | SHEET 8 |
| 23 | EMPTY | | | |
| 24 | SHEET 9 - FRONT | NO | PASS | SHEET 9 |
| 25 | EMPTY | | | |
| 26 | SHEET 10 - FRONT | NO | PASS | SHEET 10 |
| 27 | EMPTY | | | |
| 28 | SHEET 11 - FRONT | NO | PASS | SHEET 11 |
| 29 | EMPTY | | | |
| 30 | SHEET 12 - FRONT | NO | PASS | SHEET 12 |

FIGURE 4

IMAGE-FORMING JOB

| SHEET NUMBER | SHEET TYPE |
|---|---|
| 1 | DUPLEX SHEET |
| 2 | DUPLEX SHEET |
| 3 | INSERTED SHEET |
| 4 | DUPLEX SHEET |
| 5 | DUPLEX SHEET |
| 6 | DUPLEX SHEET |
| 7 | DUPLEX SHEET |
| 8 | DUPLEX SHEET |
| 9 | DUPLEX SHEET |
| 10 | DUPLEX SHEET |
| 11 | DUPLEX SHEET |
| 12 | DUPLEX SHEET |

FIGURE 5

PRIOR ART

| FRAME NUMBER | MARKING ENGINE | INVERTER | INSERTER | FINISHER OUTPUT |
|---|---|---|---|---|
| 1 | SHEET 1 - BACK | YES | NO | |
| 2 | EMPTY | | | |
| 3 | SHEET 2 - BACK | YES | NO | |
| 4 | EMPTY | | | |
| 5 | SHEET 4 - BACK | YES | NO | |
| 6 | EMPTY | | | |
| 7 | SHEET 5 - BACK | YES | NO | |
| 8 | EMPTY | | | |
| 9 | SHEET 6 - BACK | YES | NO | |
| 10 | SHEET 1 - FRONT | NO | PASS | SHEET 1 |
| 11 | SHEET 7 - BACK | YES | NO | |
| 12 | SHEET 2 - FRONT | NO | PASS | SHEET 2 |
| 13 | EMPTY | | SHEET 3 | SHEET 3 |
| 14 | SHEET 4 - FRONT | NO | PASS | SHEET 4 |
| 15 | SHEET 8 - BACK | YES | NO | |
| 16 | SHEET 5 - FRONT | NO | PASS | SHEET 5 |
| 17 | SHEET 9 - BACK | YES | NO | |
| 18 | SHEET 6 - FRONT | NO | PASS | SHEET 6 |
| 19 | SHEET 10 - BACK | YES | NO | |
| 20 | SHEET 7 - FRONT | NO | PASS | SHEET 7 |
| 21 | SHEET 11 - BACK | YES | NO | |
| 22 | EMPTY | | | |
| 23 | SHEET 12 - BACK | YES | NO | |
| 24 | SHEET 8 - FRONT | NO | PASS | SHEET 8 |
| 25 | EMPTY | | | |
| 26 | SHEET 9 - FRONT | NO | PASS | SHEET 9 |
| 27 | EMPTY | | | |
| 28 | SHEET 10 - FRONT | NO | PASS | SHEET 10 |
| 29 | EMPTY | | | |
| 30 | SHEET 11 - FRONT | NO | PASS | SHEET 11 |
| 31 | EMPTY | | | |
| 32 | SHEET 12 - FRONT | NO | PASS | SHEET 12 |

FIGURE 7

JOB ORDERING SYSTEM FOR AN IMAGE-FORMING MACHINE

FIELD OF THE INVENTION

This invention generally relates to job ordering systems for image-forming machines. More particularly, this invention relates job ordering systems for image-forming machines having one or more inserted sheets in a image-forming job.

BACKGROUND OF THE INVENTION

Image-forming machines are used to transfer images onto sheets of paper or other medium. In a typical image-forming job, the image-forming machine transfers one or more images onto one or more sheets. When multiple images are transferred, the image-forming process usually transfers the images to arrange the output sheets according to the image-forming job. The output sheet sequence typically corresponds to the image input sequence into the image-forming machine. This ordered input and corresponding output avoids the need to reassemble or otherwise compile the sheets.

Many image-forming machines have a marking engine, an inserter, and a finisher. The marking engine transfers images onto the sheets. If required by the image-forming job, the inserter inserts a preprinted or blank sheet into the sheet output from the marking engine. The finisher collects the output sheets to complete the image-forming job or prepare it for subsequent processing operations.

The marking engine usually has image-forming equipment combined with a sheet feeder and an inverter. The sheet feeder provides the selected paper or other medium to the image-forming equipment for transferring an image. In the image-forming equipment, a photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred to a sheet of paper or other medium. A fusing station heats the sheet so the toner adheres to the sheet. The photoconductor is refreshed, cleaned to remove residual toner and charge, and is then ready to make another image. The sheet exits the marking engine.

The inverter helps the marking engine make duplex sheets—where images are transferred onto both sides of a sheet. To form a duplex sheet, a first image is transferred onto one side of a sheet. The sheet is routed through the inverter, which "inverts" or turns the sheet so the opposite side is exposed to the image-forming equipment. The inverter returns the sheet to the image-forming equipment, where a second image is transferred onto the other side of the sheet.

FIG. 5 is a representation of an image-forming job having twelve sheets. Sheet 3 is an inserted sheet and may be preprinted, blank, or the like. The inserted sheet is processed through the inserter. Sheets 1–2 and 4–12 are duplex sheets, where images are transferred onto both sides of a sheet. The duplex sheets are processed on both sides by the marking engine before passing through the inserter into the finisher.

A job ordering system divides the image-forming job into sequential events or frames related to the operation of the image-forming machine. In the frames, the image-forming machine produces output sheets in a sheet sequence corresponding to the order for the image-forming job. Generally, the image-forming job is ordered when it is sent or provided to the image-forming machine.

The job ordering system usually follows criteria based on the mechanical configuration of the image-forming machine. Generally, the back image of a duplex sheet is processed first to avoid having to invert the sheet again. A front image of a duplex sheet is separated from a corresponding back image by a certain number of frames. In one approach, the front image is separated from a corresponding back image by eight frames.

When a duplex sheet is processed, the sheet remains inside the image-forming machine after the first side is processed. The duplex sheet then passes through the inverter. The output for such a frame is an empty space. The image-forming equipment processes the duplex sheet again. Once images are transferred on the back and front sides, the duplex sheet exits the image-forming machine.

FIG. 7 is a representation of a job ordering system for the image-forming job in FIG. 5 according to the prior art. The activities of the marking engine, inverter, inserter, and finisher are summarized for each frame. In the marking engine, images are transferred onto the back sides of duplex sheets 1, 2, 4, 5, 6, 7, 8, 9, 10, 11, and 12 in frames 1, 3, 5, 7, 9, 11, 15, 17, 19, 21, and 23 respectively. Sheets 1, 2, 4, 5, 6, 7, 8, 9, 10, 11, and 12 pass through the inverter after the respective back images are formed. Accordingly, frames 2, 4, 6, 8, 13, 22, 25, 27, 29, and 31 are empty. Images are transferred onto the front sides of sheets 1, 2, 4, 5, 6, 7, 8, 9, 10, 11, and 12 in frames 10, 12, 14, 16, 18, 20, 24, 26, 28, 30, and 32 respectively. After the front images are formed, sheets 1, 2, 4, 5, 6, 7, 8, 9, 10, 11, and 12 exit the marking engine, passing through the inserter to the finisher. As the sheets exit the marking engine, the inserter places the inserted sheet 3 between duplex sheets 2 and 4. The finisher outputs sheets 1, 2, 3, 4, 5, 6, 7, 8, 9, 10, 11, and 12 sequentially. This job ordering system takes 32 frames and, in one approach, has a sheet output rate of less than about 55 pages per minute.

In the job ordering system, the skip or empty frames help provide a sheet output corresponding to the sheet sequence of the image-forming job. However, the skip frames increase the process time to complete the image-forming job. The skip frames also increase maintenance of the image-forming equipment. Essentially, the skip frames use the image-forming equipment without transferring images.

Accordingly, a job ordering system is needed for an image-forming machine that uses fewer empty frames and maintains the sheet output in accordance with an image-forming job.

SUMMARY

The invention provides a job ordering system for an image-forming machine that transfers an image onto a sheet at essentially the same time in which an inserter places an inserted sheet into a sheet output path. While the image transfer and sheet insertion occur at essentially the same time or within the same frame of an image-forming job, these events occur at different locations in the image-forming machine.

In one aspect, the image-forming machine with a job ordering system has image-forming equipment, a sheet output path, and an inserter. The image-forming equipment transfers an image onto a sheet. The image-forming equipment may transfer one or more images onto a plurality of sheets according to a sheet sequence for an image-forming job. The image-forming job may have one or more frames and one or more inserted sheet positions. The sheet output path receives the sheet from the image-forming machine. The sheet output path may receive a plurality of sheets from the image-forming machine. The inserter places an inserted sheet onto the sheet output path at essentially the same time as the image-forming equipment transfers the image onto the sheet. The inserter may place one or more inserted sheets onto the sheet output path at one or more inserted sheet positions. The image-forming equipment may transfer one or more images onto the plurality of sheets at essentially the same time as the inserter places one or more inserted sheets onto the sheet output path.

The image-forming machine may have a marking engine, an inverter, and a finisher. The image-forming machine may be enclosed inside a housing. The sheet output path may include one or more conveyors in the marking engine, the inverter, and the finisher. The marking engine includes the image-forming equipment and may include a feeder assembly and an inverter. The image-forming equipment may have a photoconductor, a primary charger, an exposure machine, a toning station, a transfer charger, and a fuser station.

In a method for ordering an image-forming job on an image-forming machine, an inserted sheet is placed onto an output sheet path at essentially the same time as an image is transferred onto a sheet. In an alternate method, one or more images are transferred onto a plurality of sheets according to a sheet sequence for an image-forming job. The image-forming job may have one or more frames and one or more inserted sheet positions. One or more inserted sheets are placed on the sheet output path at one or more of the inserted sheet positions. The one or more inserted sheets are placed on the sheet output path at essentially the same time as the one or more images are transferred onto the plurality of sheets.

According to further aspects of the invention, methods and apparatus for ordering an image-forming job on an image-forming machine are provided, comprising transferring at least one image onto a plurality of sheets with interleave duplex according to a sheet sequence for an image-forming job, wherein the image-forming job has at least one inserted sheet position; and placing at least one inserted sheet onto a sheet output path at the at least one inserted sheet position corresponding to an interleave duplex space.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIG. 4 is a representation of a job ordering system for an image-forming machine.

FIG. 5 is a representation of an image-forming job having twelve sheets.

FIG. 7 is a representation of a job ordering system for an image-forming machine according to the prior art.

DETAILED DESCRIPTION OF THE PREFERRED EMBODIMENTS

Figure 1:
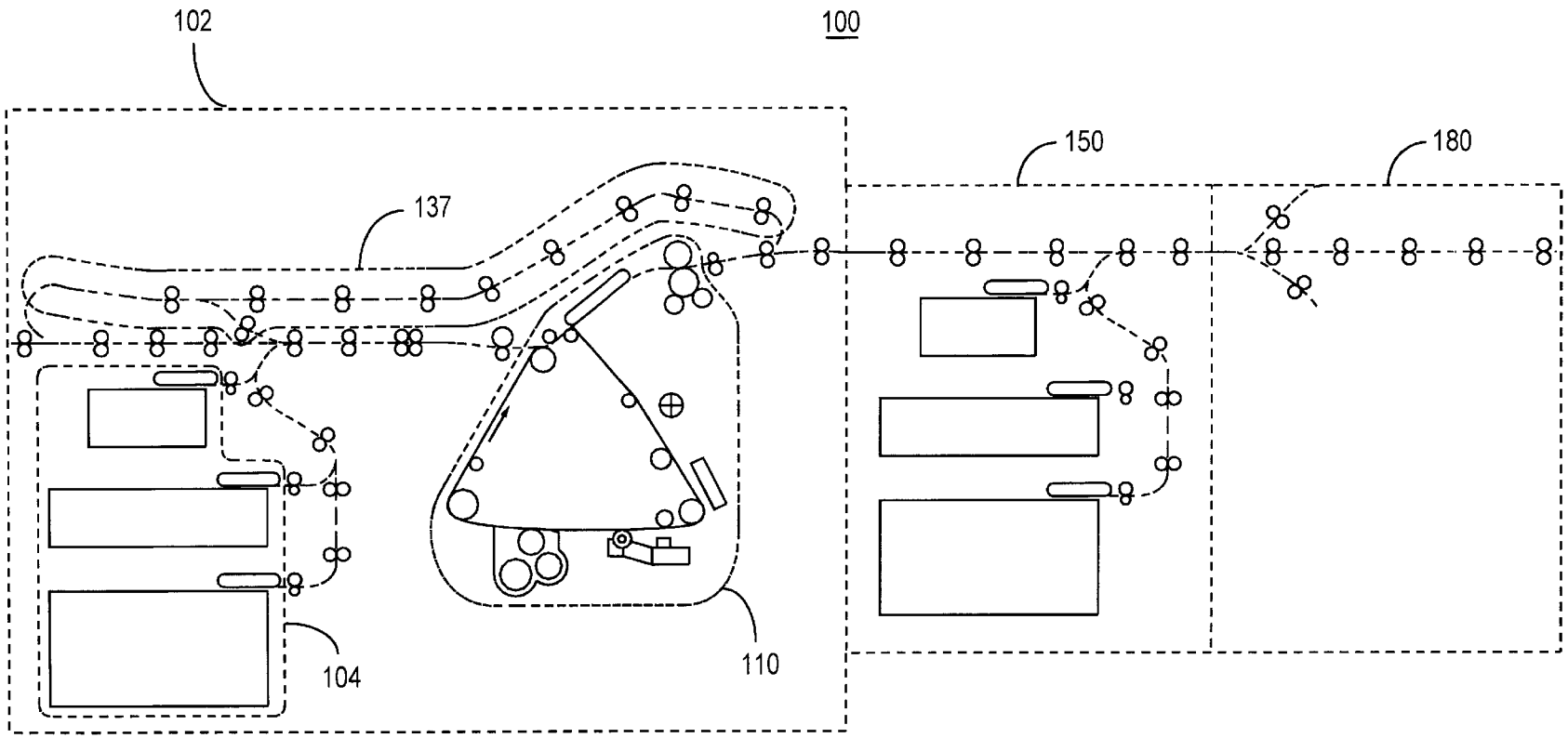
FIG. 1 is a schematic diagram of an image-forming machine having a job ordering system.
Figure 2:
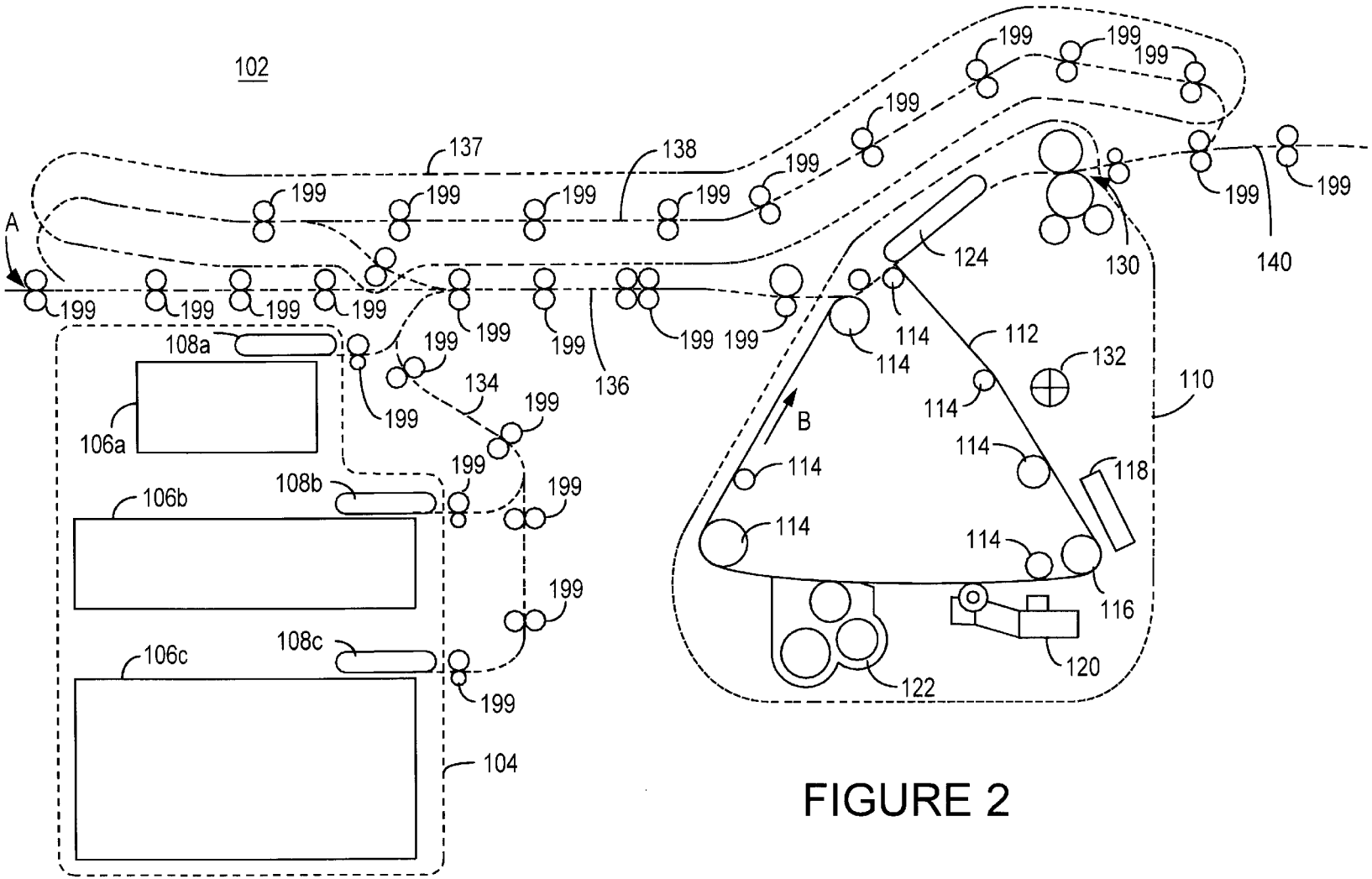
FIG. 2 is a close-up schematic diagram of the marking engine for the image-forming machine shown in FIG. 1.
Figure 3:
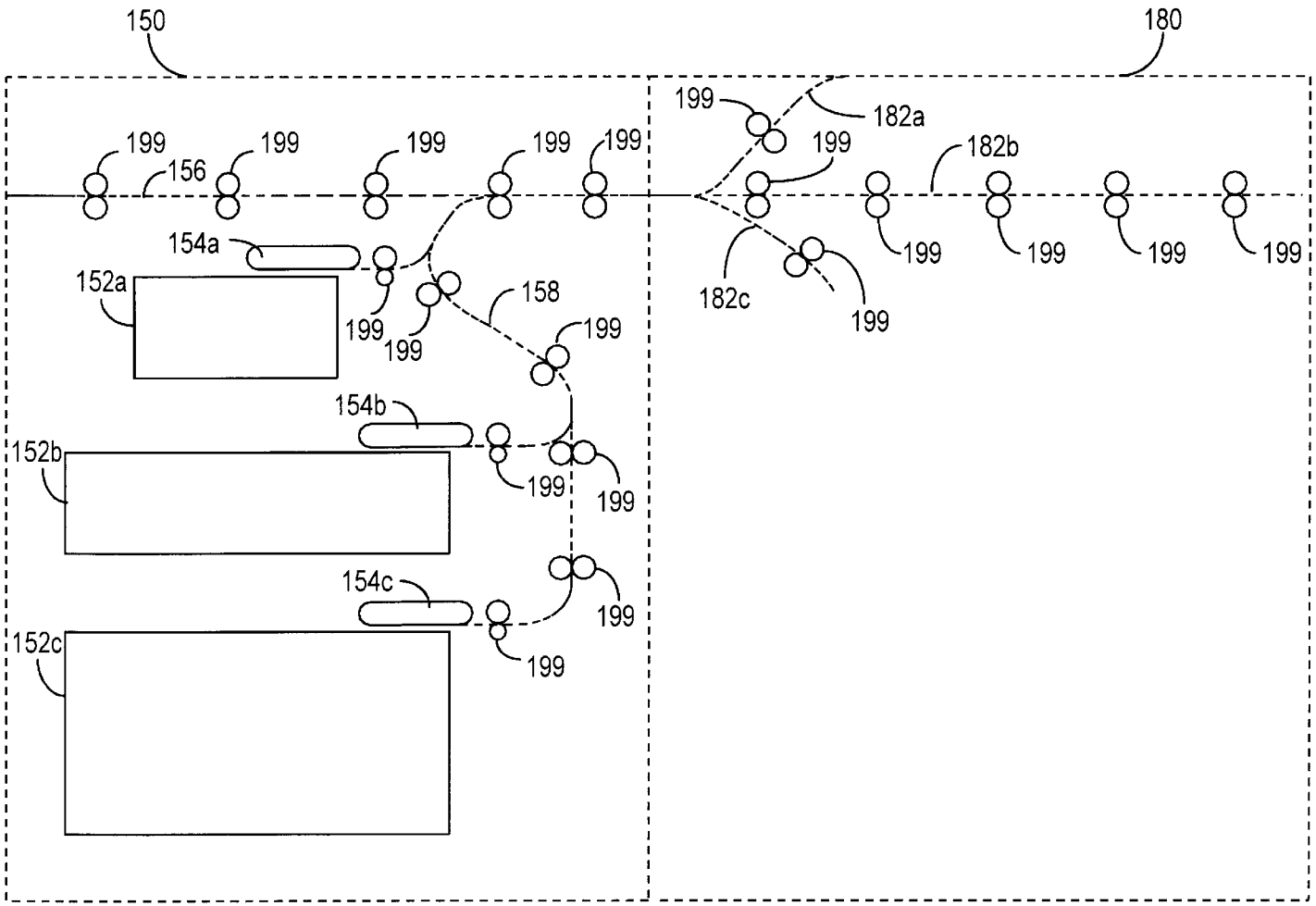
FIG. 3 is a close-up schematic diagram of the inserter and finisher for the image-forming machine shown in FIG. 1.

FIG. 1 is a schematic diagram of an image-forming machine 100 having a job ordering system. The image-forming machine 100 includes a marking engine 102, an inserter 150, and a finisher 180. FIG. 2 is a close-up schematic diagram of the marking engine 102 shown in FIG. 1. FIG. 3 is a close-up schematic diagram of the inserter 150 and the finisher 180 shown in FIG. 1.

The image-forming machine 100 also may have a housing (not shown), which encases the marking engine 102, the inserter 150, and the finisher 180. The housing may be a single unit or may be in modular form. The housing supports and protects various components of the image-forming machine 100. In one aspect, there are interconnected module subhousings for the marking engine 102, the inserter 150, and the finisher 180. While apparently particular configurations and arrangements are shown for the image-forming machine 100, other configurations and arrangements may be used including those with fewer and additional components.

In one aspect, the marking engine 102 has image-forming equipment 110, a feeder assembly 104, and an inverter 137 interconnected by conveyors 134, 136, 138, and 140. The conveyors 134, 136, 138, and 140 may be any suitable conveyance mechanism or a combination for moving sheets throughout the marking engine 102. Sheets may be paper and other medium such as transparencies, cardboard, poster board, and the like. The conveyors 134, 136, 138, and 140 may have a belt, linked plate, or other suitable configuration. The conveyors 134, 136, 138, and 140 may be solid or perforated, and may work with pressurized air, a vacuum, or combination system to keep the sheets in position such as against the conveyor. Guides and similar devices (not shown) may be present to divert or direct the sheets onto another conveyor or in a particular direction. The conveyors 134, 136, 138, and 140 operate in conjunction with conveyor rollers 199, of which any one or more may be a motor driven roller. The conveyor rollers 199 may be configured in pairs oppositely disposed on a conveyor. The conveyor rollers 199 may have other configurations suitable for moving the sheets. Alternatively, the conveyors 134, 136, 138, and 140 may be a passage or path for the sheets to follow. The conveyor rollers 199 may be disposed such that at least one roller or one pair of rollers is in contact with each sheet at any position along a conveyor.

The feeder assembly 104 supplies paper or other medium to the image-forming equipment 110. The marking engine 102 may have a feeder position A to bypass the feeder assembly 104. At feeder position A, a user may feed a sheet or other medium onto the input conveyor 136. The feeder assembly 104 includes sheet storage bins 106*a*, 106*b*, and 106*c* having sheet dispenser devices 108*a*, 108*b*, and 108*c*, respectively.

The sheet storage bins 106*a*, 106*b*, and 106*c* hold sheets of paper or other medium. The sheets may be the same, different, and a combination of sizes. The sheets also may be the same, different, and a combination of paper and other medium. There may be only one sheet storage bin. There may be other multiples of sheet storage bins, including those of different sizes.

The sheet dispenser devices 108*a*, 108*b*, and 108*c* extract a sheet from the storage bins 106*a*, 106*b*, and 106*c* and dispense the sheet onto a feeder conveyor 134. As with the storage bins, there may be only one or other multiples of sheet dispenser devices. The feeder conveyor 134 moves the sheet onto the input conveyor 136, which transports the sheet to the image-forming equipment 110.

The image-forming equipment 110 may be a copy machine, a facsimile machine, an electrophotographic image-forming machine, and the like. In one aspect, the image-forming equipment 110 has a photoconductor 112, support rollers 114, a motor driven roller 116, a primary charger 118, an exposure machine 120, a toning station 122, a transfer charger 124, a fusing station 130, a cleaner 132, related equipment, accessories, and the like. The related equipment and accessories may include a logic and control unit (not shown) and a user interface (not shown). The photoconductor 112 is operatively mounted on the support rollers 114. The motor driven roller 116 moves the photoconductor 112 in the direction indicated by arrow B. The primary charger 118, the exposure machine 120, the toning station 122, the transfer charger 124, the fusing station 108, and the cleaner 132 are operatively disposed adjacent to the photoconductor 112. The primary charger electrostatically charges the photoconductor. The exposure machine optically exposes and forms an electrostatic image on the photoconductor. The toning station applies toner on the photoconductor. The toner has a charge to adhere to the electrostatic image. The transfer charger transfers the toner from the photoconductor onto a sheet. The fuser station receives the sheet from the transfer charger and fuses the toner to the sheet. Preferably, the photoconductor 112 has a belt and roller-mounted configuration, but may have a drum or other suitable configuration.

The image-forming equipment 110 transfers images onto sheets of paper and other medium. The image-forming equipment 110 may transfer an image onto one side of a sheet and may transfer one or more images onto both sides of a sheet. Duplex sheets are where images are transferred onto both sides of a sheet. After the image-forming equipment 110 transfers the image, the sheet exits the image-forming equipment 110 onto the output conveyor 140.

The inverter 137 helps the image-forming equipment 110 make duplex sheets. The inverter 137 may not be used when a sheet is not a duplex sheet. The inverter 137 includes an inverter conveyor 138, which may have any suitable configuration or be any suitable mechanism for inverting the sheets. The inverter 137 may turn the duplex sheet upside down prior to transferring the duplex sheet onto the input conveyor 136. The inverter 137 may have a transfer tray (not shown) or similar device to assist inverting the duplex sheet. After a first image is transferred onto a first side of a duplex sheet, the duplex sheet exits the image-forming equipment 110 on the output conveyor 140. The first side may be the back side of the duplex sheet. The duplex sheet is diverted onto the inverter conveyor 138, which inverts the duplex sheet and delivers the duplex sheet to the input conveyor 136. The duplex sheet enters the image-forming equipment 110 for the second time. A second image is transferred onto a second side of a duplex sheet. The second side may be the front side of the duplex sheet. The duplex sheet exits the image-forming equipment 110 and the marking engine 102 on the output conveyor 140, bypassing the inverter 137.

Sheets exit the marking engine 102 on the output conveyor 140. The sheets are transferred to a pass-through conveyor 156 as the sheets enter the inserter 150. The output conveyor 140 and the pass-through conveyor 156 form a sheet output path and may be the same conveyor. The sheet output path may include only the output conveyor 140 and may include other conveyors such as one or more of finisher conveyors 182*a*, 182*b*, and 182*c*. If there are no inserted sheets in the image-forming job, the sheets exit the inserter 150 and enter the finisher 180. If there are inserted sheets in the image-forming job, the inserter 150 places the inserted sheets between the appropriate output sheets from the marking engine 102. The sheets, including the one or more inserted sheets, exit the inserter 150 and enter the finisher 180.

The inserter 150 includes insert storage bins 152*a*, 152*b*, and 152*c* having insert dispenser devices 154*a*, 154*b*, and 154*c*, respectively. At the appropriate position in the sheet output from the marking engine 102, an inserted sheet position, one or more of the insert dispenser devices 154*a*, 154*b*, and 154*c* provides one or more inserted sheets to the insert conveyor 138 from one or more of the storage bins 152*a*, 152*b*, and 152*c*. The insert conveyor 158 provides the one or more inserted sheets onto the pass-through conveyor 156. The inserted sheet position corresponds to sheet sequence for the image-forming job.

The sheet storage bins 152*a*, 152*b*, and 152*c* hold inserted sheets, which may be blank, preprinted, and the like. The inserted sheets may be the same size, different sizes, and a combination of sizes. The inserted sheets may be the same, different, and a combination of paper and other medium. The inserted sheets may be the same size as the sheets provided by the feeder assembly 104 to the image-forming equipment 111. The inserted sheets also may be the same paper or other medium as the sheets provided by the feeder assembly 104. There may be only one insert storage bin. There may be other multiples of insert storage bins, including those of different sizes.

The insert dispenser devices 154*a*, 154*b*, and 154*c* extract an inserted sheet from the storage bins 152*a*, 152*b*, and 152*c* and dispense the inserted sheet onto an inserter conveyor 158. As with the insert bins, there may be only one or other multiples of insert dispenser devices.

In the finisher 180, the sheets are transferred onto one of the finisher conveyors 182*a*, 182*b*, and 182*c*. The finisher 180 collects the sheet output to complete the image-forming job or prepare it for subsequent processing operations. Each of the finisher conveyors 182*a*, 182*b*, and 182*c* may lead to one or more finishing operations (not shown) such as stapling, binding, collation, and the like. One of the finisher conveyors 182*a*, 182*b*, and 182*c* may be the same as the pass-through conveyor 156. There may be only one finisher conveyor and other multiples of finisher conveyors.

In use, the image-forming machine 100 transfers images to sheets according to a job ordering system for an image-forming job. The job ordering system divides the image-forming job into sequential events related to operation of the image-forming machine. The sequential events or frames enable the image-forming machine 100 to output sheets in a sequential order corresponding to the sheet sequence for the image-forming job. In one aspect, the image-forming job is in order when it is sent or provided to the image-forming machine. The logic and control unit (LCU) or another microprocessor (not shown) of the image-forming machine 100 may have control logic control to perform the job ordering system. A user may enter the job ordering through the user interface (not shown). The image-forming machine 100 may assume a job ordering system based upon the sequence the images as they are provided to the image-forming machine 100. A user also may provide a sequence of images along with instructions for placing an inserted sheet in the output sequence.

The job ordering system transfers an image onto a sheet in the same frame or sheet insertion position in which the inserter 180 places an inserted sheet onto the sheet output path of the marking engine 102. The image transfer and inserted sheet insertion occur at essentially the same time. However, these events occur at different locations in the image-forming machine 100. This combination of image transfer and sheet insertion occurs in the same frame. However, the same or similar combination may occur in one or more frames, in any frame, and in any combination of frames in the job ordering system. Any of the sheets may be combined with any of the inserted sheets in the image-forming job. There may be different combinations for different frames. Additionally, the inserted sheet insertion may occur on the front, back, and both the front and back of a duplex sheet. One or more of the inserted sheets may be placed on the sheet output path in the same frame or same sheet insertion position.

The job ordering system may be based on the mechanical configuration of the image-forming machine 100. The job ordering system also may be based on reducing the number of skipped frames in the image-forming process. The sheet may be a duplex sheet. In one aspect, the marking engine 102 transfers an image onto a back side of a duplex sheet in the same frame when the inserter 180 places an inserted sheet into the sheet output of the marking engine 102. Additionally, the back image of a duplex sheet may be processed first to avoid having to invert the sheet again. The front image of the duplex sheet may be separated from a corresponding back image by a certain number of frames. The front image of a duplex sheet may be separated from a corresponding back image by eight frames. A duplex sheet remains inside the marking engine 102 after the back side is processed. The partially processed duplex sheet passes through the inverter 137, resulting in no output or an empty space for the frame. Once images are transferred onto the front and back sides, the duplex sheet exits the marking engine 111.

While an apparently particular representation of a job ordering system is shown, the job ordering system may have other representations such as inserting additional or other inserted sheets and inserting the inserted sheet at additional or other frames. The job ordering system may be done for other image-forming machines including image-forming machines having additional or other mechanical and operating properties. The job ordering system may be done for image-forming machines having various mechanical and operating properties as long as the marking engine transfers an image onto a sheet in the same frame or at essentially the same time in which the inserter places an inserted sheet onto the sheet output path of the image-forming machine.

FIG. 5 is a representation of an image-forming job having twelve sheets. Sheet 3 is an inserted sheet. Sheets 1–2 and 4–12 are duplex sheets. FIG. 4 is a representation of a job ordering system for the image-forming job in FIG. 5 that utilizes interleave duplex (alternating one sheet with one empty frame). The job ordering system is conducted sequentially by frame number. The activities of the marking engine, inverter, inserter, and finisher are summarized for each frame. In the job ordering system, frame number 13 also is an inserted sheet position and corresponds to an interleave duplex space in the output stream. There may be other or additional inserted sheet positions. Frame 13 includes transferring an image onto a back side of duplex sheet 8 and inserting sheet 3 onto the sheet output path. However, they occur in different locations of the image-forming machine 100, namely the marking engine 102 and the inserter 150.

In the image-forming machine 100, images are transferred onto the back sides of duplex sheets 1, 2, 4, 5, 6, 7, 8, 9, 10, 11, and 12 in frames 1, 3, 5, 7, 9, 11, 13, 15, 17, 19, and 21, respectively. These duplex sheets are routed through the inverter 137. Frames 2, 4, 6, 8, 23, 25, 27, and 29 are empty. Images are transferred onto the front sides of duplex sheets 1, 2, 4, 5, 6, 7, 8, 9, 10, 11, and 12 in frames 10, 12, 14, 16, 18, 20, 22, 24, 26, 28, and 30, respectively. After each front image is formed, sheets 1, 2, 4, 5, 6, 7, 8, 9, 10, 11, and 12 exit the marking engine 102, bypass the inverter 137, and pass through the inverter 150. In frame 13, the inserter inserts Sheet 3 between duplex Sheets 2 and 4 as they exit the marking engine. Also in frame 13, the marking engine transfers an image onto the back side of Sheet 8, which exits the marking engine 102 and passes through the inverter 137. The marking engine transfers an image onto the front side of Sheet 8 in frame 22. The finisher outputs sheets 1, 2, 3, 4, 5, 6, 7, 8, 9, 10, 11, and 12 sequentially. The job ordering system takes 30 frames, which increases the effective output image-forming rate. In one aspect, the job ordering system has a sheet output rate of more than about 55 pages per minute. The job ordering system may include other or additional frames in which the inserter 150 places an inserted sheet in the sheet output at essentially the same time as the marking engine 105 transfers an image onto a sheet.

Figure 6:
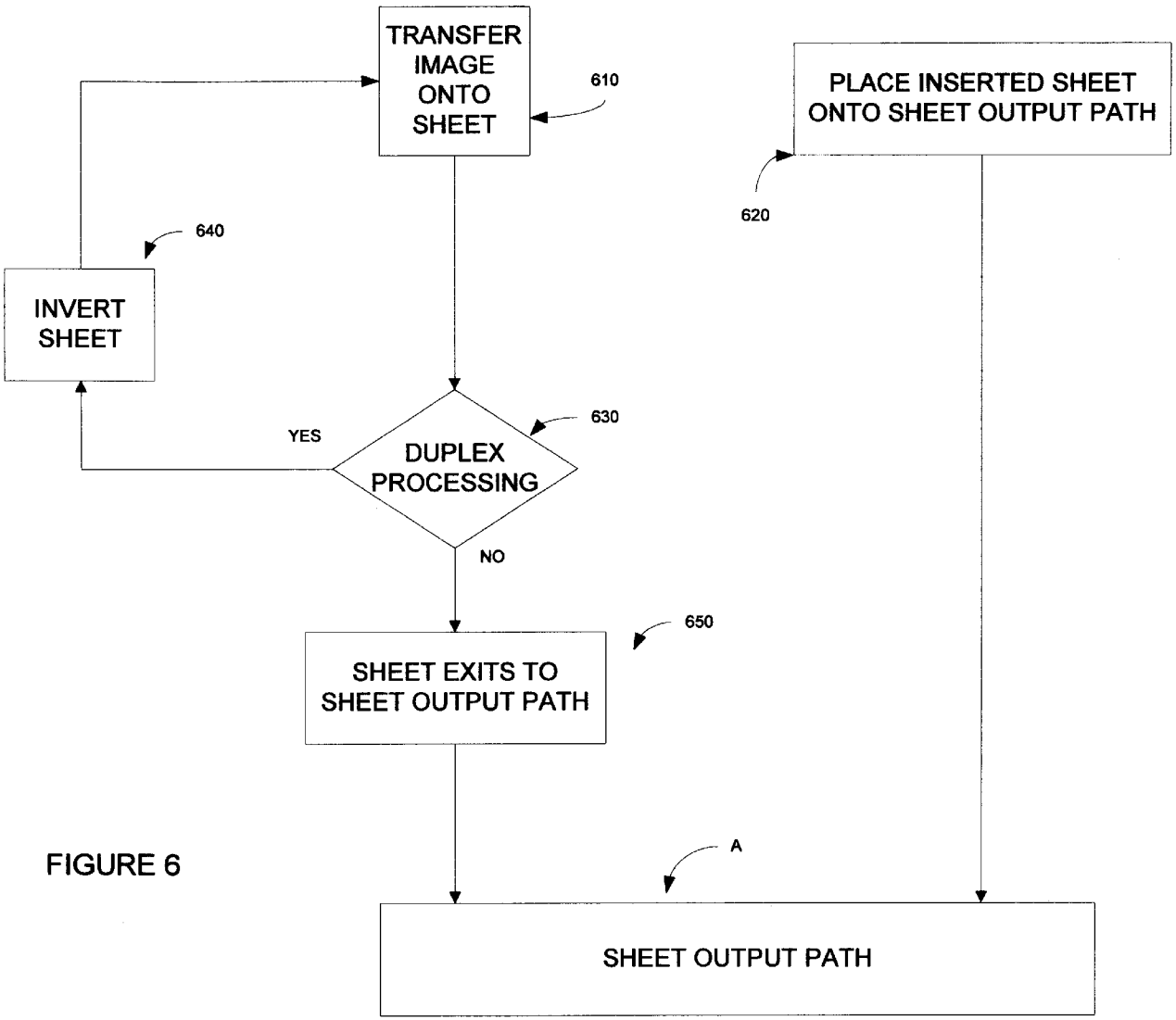
FIG. 6 is a flowchart of a method for ordering an image-forming job on an image-forming machine.

FIG. 6 is a flowchart of a method for ordering an image-forming job on an image-forming machine. As discussed, the image-forming equipment transfers 610 an image onto a sheet. The image forming equipment may transfer the image onto the front side or the back side of a duplex sheet. In one aspect, the image is transferred to the back side of a duplex sheet. The image forming equipment may transfer one or more images onto a plurality of sheets according to a sheet sequence for an image-forming job. The image-forming job may have one or more frames or inserted sheet positions.

The inserter places 620 an inserted sheet onto an output sheet path A at essentially the same time as the image is transferred 610 onto the sheet. The inserter may place the inserted sheet onto the output sheet path when the image is transferred onto the front or back side of a duplex sheet. In one aspect, the inserted sheet is placed on the output sheet path at essentially the same time as the image is transferred onto the back side of a duplex sheet. The inserter may place one or more inserted sheets onto the sheet output path at one or more frames or inserted sheet positions.

If the sheet requires duplex processing 630, an inverter inverts 640 the sheet and returns the sheet to the image-forming equipment. A sheet may require duplex processing when the sheet is a duplex sheet—has images formed on both sides. Another image is then transferred 610 onto the sheet. The image may be the same or a different image. In one aspect, the inserter does not place another inserted sheet onto the sheet output path when the sheet undergoes duplex processing. If the sheet does not require duplex processing 630, the sheet exits 650 the image-forming equipment onto the sheet output path A.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image-forming machine with a job ordering system, comprising:

image-forming equipment to transfer at least one image onto sheets with interleave duplex;

a sheet output path operatively connected to receive the sheet from the image-forming machine; and an inserter operatively disposed adjacent to the sheet output path, the inserter timed to place an inserted sheet onto the sheet output path into an interleave duplex space.

2. An image-forming machine according to claim 1, where the image-forming equipment comprises:

a photoconductor;

at primary charger operatively disposed to electrostatically charge the photoconductor;

an exposure machine operatively disposed to optically expose and form an electrostatic image on the photoconductor;

a toning station operatively disposed to apply toner on the photoconductor, the toner having a charge to adhere to the electrostatic image;

a transfer charger operatively disposed adjacent to the photoconductor, the transfer charger to transfer the toner from the photoconductor onto the sheet; and a fuser station operatively disposed to receive the sheet from the transfer charger, the fuser station to fuse the toner to the sheet.

3. An image-forming machine according to claim 1, where the image-forming equipment is provided in a marking engine comprising a feeder assembly and an inverter, the feeder assembly to supply the sheet to the image-forming machine, the inverter to invert and return the sheet to the image-forming machine.

4. An image-forming machine according to claim 3, further comprising a finisher operatively connected to receive the sheet and the inserted sheet from the sheet output path.

5. An image-forming machine according to claim 1, further comprising an inverter operatively connected to the image-forming equipment, the invertor to receive the duplex sheet from the image-forming equipment, the invertor to invert and return the duplex sheet to the image-forming equipment.

6. An image-forming machine with a job ordering system, comprising:

image-forming equipment to trasfer at least one image onto a pluraility of sheets with interleave duplex according to a sheet sequence for an image-forming job, where the image-forming job has at least one inserted sheet position;

a sheet output path operatively connected to receive the plurality of sheets from the image-forming machine; and an inserter operatively disposed adjacent to the sheet output path, the inserter timed to place at least one inserted sheet onto the sheet output path at the at least one inserted sheet position into an interleave duplex space.

7. An image-forming machine according to claim 6, where the at least one image comprises a first image and a second image, where the plurality of sheets comprises a first sheet and a second sheet, where that at least one inserted sheet position comprises a first inserted sheet position and a second inserted sheet position, where the image-forming equipment transfers the first image onto the first sheet in the first inserted sheet position, where the image-forming equipment transfers the second image onto the second sheet in a second inserted sheet position, and where the inserter places the at least one inserted sheet onto the sheet output path in at least one of the first and second inserted sheet positions.

8. An image-forming machine according to claim 7, where the at least one inserted sheet comprises a first inserted sheet and a second inserted sheet, where the inserter places the first inserted sheet onto the sheet output path in the first inserted sheet position, and where the inserter places the second inserted sheet onto the sheet output path in the second inserted sheet position.

9. A method for ordering an image-forming job on an image-forming machine, comprising steps:

(a) transferring at least one image onto sheets with interleave duplex; and (b) placing an inserted sheet onto an output sheet path into an interleave duplex space.

10. A method for ordering an image-forming job on an image-forming machine, comprising steps:

(a) transferring at least one image onto a plurality of sheets with interleave duplex according to a sheet sequence for an image-forming job, where the image-forming job has at least one inserted sheet position; and placing at least one inserted sheet onto a sheet output path at the at least one inserted sheet position corresponding to an interleave duplex space.

* * * * *